US006855012B2

(12) United States Patent
An

(10) Patent No.: US 6,855,012 B2
(45) Date of Patent: Feb. 15, 2005

(54) HIGH CAPACITY ELECTRICAL TERMINAL CONNECTION

(75) Inventor: Hyeon-Su An, Sungnam (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/445,854

(22) Filed: May 28, 2003

(65) Prior Publication Data

US 2004/0005823 A1 Jan. 8, 2004

(30) Foreign Application Priority Data

Jul. 4, 2002 (KR) ..... 10-2002-0038713

(51) Int. Cl.[7] ..... H01R 11/03
(52) U.S. Cl. ..... 439/793; 439/801; 439/864
(58) Field of Search ..... 439/791–793, 439/806, 801, 864, 290, 775

(56) References Cited

U.S. PATENT DOCUMENTS 1,481,553 A * 1/1924 Hanson ..... 439/864
4,002,390 A * 1/1977 Perry et al. ..... 439/433
4,032,212 A * 6/1977 Faust et al. ..... 439/412
4,118,097 A * 10/1978 Budnick ..... 439/387
4,181,396 A * 1/1980 Olashaw ..... 439/801
4,601,451 A * 7/1986 Leonardo ..... 248/74.1
4,632,497 A * 12/1986 Boysen ..... 439/733.1
4,995,824 A * 2/1991 Falco ..... 439/290
5,118,299 A * 6/1992 Burns et al. ..... 439/74
5,176,530 A * 1/1993 Reylek et al. ..... 439/290
5,527,191 A * 6/1996 Bevis et al. ..... 439/801
5,876,224 A * 3/1999 Chadbourne ..... 439/110

* cited by examiner

*Primary Examiner*—Gary Paumen
(74) *Attorney, Agent, or Firm*—Volentine Francos & Whitt, PLLC

(57) ABSTRACT

The present invention provides a secure connection between first and second high capacity electrical terminals. A bolt unit extends through the first and second terminals and supports one side of the first terminal. A connection nut joined with the bolt unit supports a side of the second terminal remote from the first terminal. The side of the first terminal supported by the bolt unit has a surface including a first series of concavities and convexities. The side of the bolt unit in contact with the first terminal includes a second series of concavities and convexities engaged with the first series thereof. Therefore, it is difficult to pivot the joint created between the high capacity electric terminals. The bolt unit also includes a fixing bar that is pivotally supported by the shaft. The fixing bar can be rotated into a locking position to exert a compressive force on the joint.

7 Claims, 5 Drawing Sheets

HIGH CAPACITY ELECTRICAL TERMINAL CONNECTION

BACKGROUND OF THE INVENTION

1. Field of the Invention

The present invention relates to the connecting of high capacity electric terminals. More particularly, the present invention relates to the structure that connects a power supply unit of semiconductor device manufacturing equipment to a power source.

2. Description of the Related Art

In general, various units of semiconductor device manufacturing equipment, such as photolithography equipment, ion-implanting equipment, thin film deposition equipment, and etching equipment, are used to perform respective unit processes in the manufacturing of a semiconductor device. Most of such equipment consumes a large amount of electric energy. Therefore, such semiconductor equipment is connected with high capacity power cables through which a large amount of electric power is supplied to the equipment.

More specifically, a power supply unit supplies and distributes electric power to the various different units of the conventional semiconductor device manufacturing equipment. The power supply unit includes a circuit breaker for automatically interrupting the power supply in an emergency or when the manufacturing equipment begins to consume an unduly large amount of energy in excess of some predetermined amount. The power supply unit also includes a main high capacity electrical terminal. The terminal is connected by a nut and bolt to a high capacity electrical terminal of a power cable of a main power source. Electrical power for each unit of semiconductor device manufacturing equipment is thus supplied from the main power source through the high capacity electric terminals.

Most of the high capacity power cables are thick and heavy so that large amounts of electric power can be supplied therethrough. Therefore, a worker must secure the nut and bolt tightly to connect the terminal of the power supply unit with that of the power source to prevent the terminals from disconnecting under the weight of the power cable, or from swinging relative to one another due to external forces.

Also, the point at which the terminals are connected is small. The force of the joint is thus concentrated at this point. Therefore, the terminal is often bent or broken when the nut and the bolt are tightened securely enough to connect the terminal of the power supply unit with the high capacity terminal of the power cable leading to the main power source.

Moreover, compressive stress is inversely proportional to the area over which it is applied. Therefore, the stress at the small area of the point of connection of the two terminals becomes increasingly high as the nut and the bolt are tightened. This small area and its surroundings where the compressive stress is great can be heated rather easily by the current flowing through the contact area. Heat generated in this way eventually poses a fire risk.

Still further, the threads of the nut and bolt can be stripped when the nut and the bolt are tightened with excessive force. On the contrary, if the force exerted to tighten the nut and the bolt is too small, the two terminals joined by the nut and the bolt are free to swing or slide relative to each other. The friction created by such relative movement heats up the point of connection between the two terminals.

SUMMARY OF THE INVENTION

An object of the present invention is to overcome the above-described problems of the prior art. More specifically, an object of the present invention is to provide a mechanism for connecting first and second high capacity electric terminals to each other in a way that prevents the joined terminals from swinging relative to each other and from otherwise creating a risk of fire. Another object of the present invention is to provide a mechanism comprising a nut and a bolt for connecting first and second high capacity electric terminals to each other risk in a way that mitigates potential damage to the threads of the mechanism when the mechanism is tightened.

The high capacity electric terminal connection comprises a bolt unit extending through the first and second terminals and having a surface contacting one side of the first terminal, and a nut threaded to the bolt unit and having a surface contacting a side of the second terminal remote from said first terminal.

According to one aspect of the present invention, at least one of the contacting surfaces of the bolt unit and the nut has a series of concavities and convexities, and the side of the terminal contacted by that surface has another series of concavities and convexities engaged with the first series of concavities and convexities.

According to another aspect of the present invention, the bolt unit includes a bolt head contacting one side of the first terminal, a shaft having a threaded first end extending through the terminals and a second end extending through the bolt head, and a fixing bar disposed atop the bolt head. The fixing bar is pivotally supported by the second end of the shaft of the bolt unit so as to be rotatable relative to the shaft about an axis extending perpendicular to the longitudinal axis of said shaft. The fixing bar also has a bottom surface configured to exert a compressive force on the bolt head when the fixing bar is rotated from a first position to a second locking position.

BRIEF DESCRIPTION OF THE DRAWINGS

These and other objects, features and advantages of the present invention will become more clear from the following detailed description thereof made in conjunction with the accompanying drawings, in which like reference numerals denote like parts, and in which.

DETAILED DESCRIPTION OF PREFFERED EMBODIMENTS

The first preferred embodiment of the present invention will now be described in detail with reference to FIG. 1 to FIG. 4.

Figure 1:
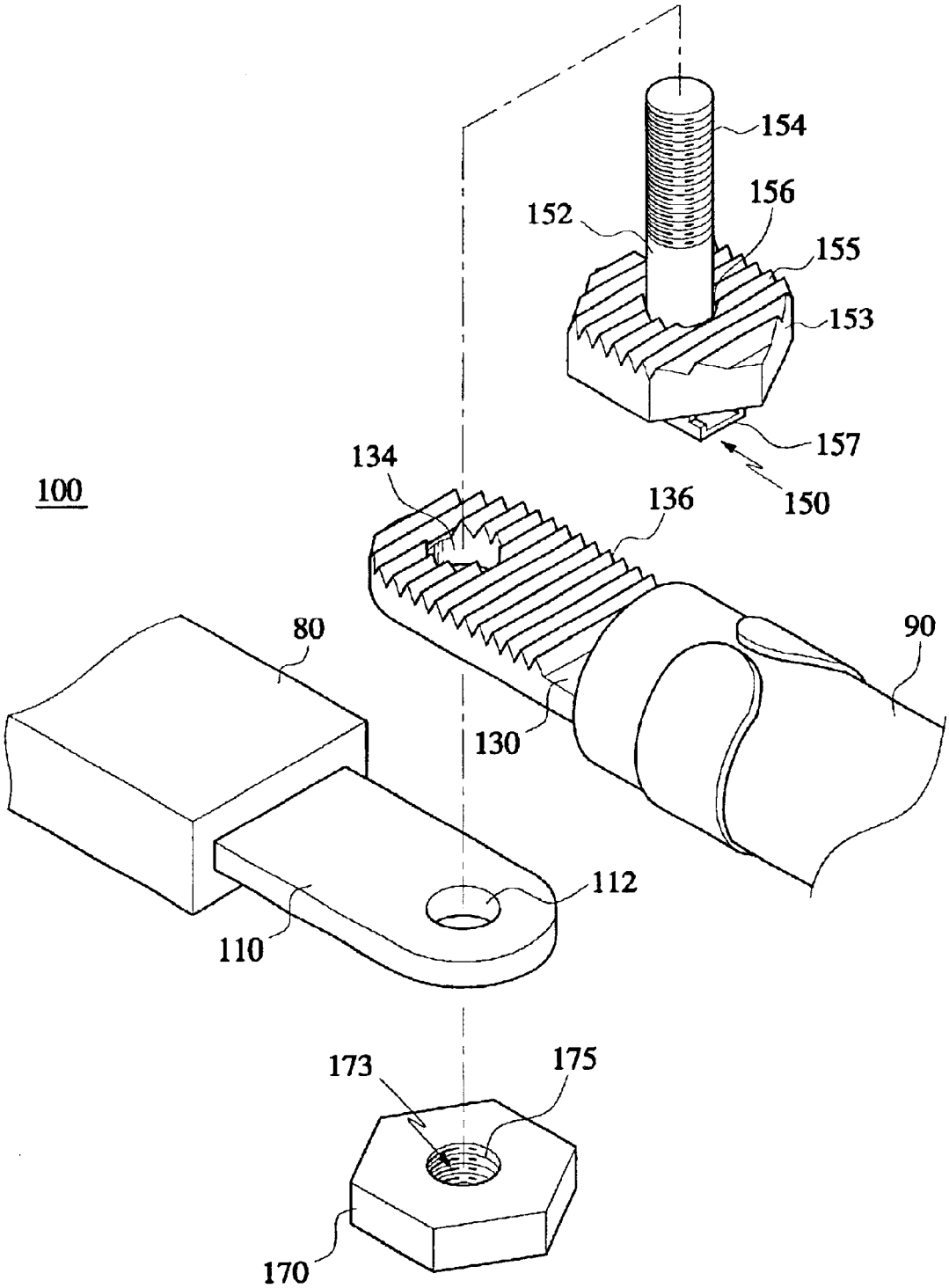
FIG. 1 is an exploded perspective view of a high capacity electric terminal connection according to the present invention.

As shown in FIG. 1, the high capacity electric terminal connection 100 of the present invention comprises two terminals 110 and 130, a bolt unit 150 extending through the terminals 110 and 130, and a connection nut 170 connected with the bolt unit 150 to compressively fix the two terminals 110 and 130 together. The high capacity electric terminal connection 100 forms a tight joint between the first terminal 130 at the end of the high capacity power cable 90, and the second terminal 110 forming the terminal end of a power supply unit 80 of semiconductor device manufacturing equipment (not shown).

The bolt unit 150 comprises a bolt head 153, a bolt shaft 152, and a fixing bar 157. The bolt head 153 contacts and supports one side of one of the two terminals 110 and 130. On the other hand, the connection nut 170 contacts and supports a distal side of the other of the two terminals 110 and 130. The bolt shaft 152 is connected with the head of the bolt 153, is inserted through the first terminal 130 and the second terminal 110, and is connected with the connection nut 170. The fixation bar 157 connects the bolt shaft 152 with the bolt head 153.

The connection nut 170 is hexagonal and has a tapped (threaded) hole 173 of a predetermined size extending centrally therethrough. The bolt head 153 of the bolt unit 150 is also hexagonal and includes an insertion hole 156 extending centrally therethrough. The bolt shaft 152 extends through the insertion hole 156 of the bolt head 153. The side of the bolt head 153 that faces the terminals 110 and 130 has a series of concavities/convexities 155 (hereinafter "serrations") that prevent the terminal 110 or 130 in contact therewith from sliding.

The bolt shaft 152 is cylindrical and has threads 154 at one end thereof. The threaded end of the bolt shaft 152 extends through the first terminal 130 and the second terminal 110 and is threaded to the connection nut 170. The other end of the bolt shaft 152, that does not have threads, extends through the insertion hole 156 of the bolt head 153.

The fixing bar 157 has a "II"-shaped cross section. The bar 157 is situated on the end of the bolt head 153 that does not contact the terminal 110 or 130, and is pinned to the end of the bolt shaft 152 received in the bolt head 153. To this end, the non-threaded end of the bolt shaft 152 is inserted into the fixing bar 157. A connection pin 160 is received in a first connection hole (not shown) in the end of the bolt shaft 152, and a second connection hole (not shown) in the sides of the fixing bar 157, to pin the bolt shaft 152 and the fixing bar 157 together.

The bottom of the fixing bar 157 adjacent the bolt head 153 includes a first portion 159 lying in a first plane, and a sloped portion 158 extending contiguously from the first portion 159 in a second plane that intersect the plane of the first portion 159 at a predetermined obtuse angle. For example, in the present invention, the rear of the bottom of the fixing bar 157 is a slope portion 158 intersecting the first portion at an angle of about 135°.

Figure 2:
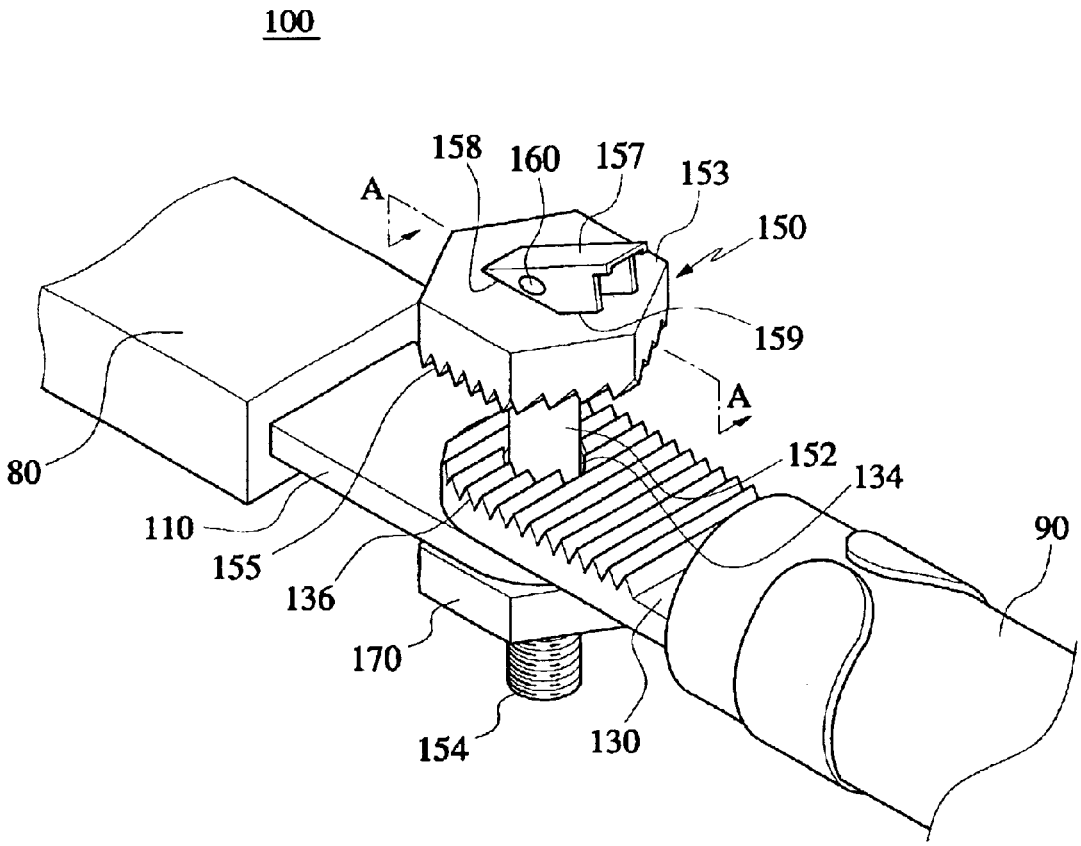
FIG. 2 is a perspective view of the terminal connection.

As shown in FIG. 2, the surface of the terminal 110 or 130 contacting the bolt head 153 can have serrations 136 corresponding to the serrations 155 of the bolt head 153. The friction force between the terminal 110 or 130 and the bolt head 153 is maximized when the serrations 136 of the terminal 110 or 130 engage the serrations 155 of the bolt head 153, to prevent the terminals 110 and 130 from swinging and sliding longitudinally relative to each other.

Figure 5:
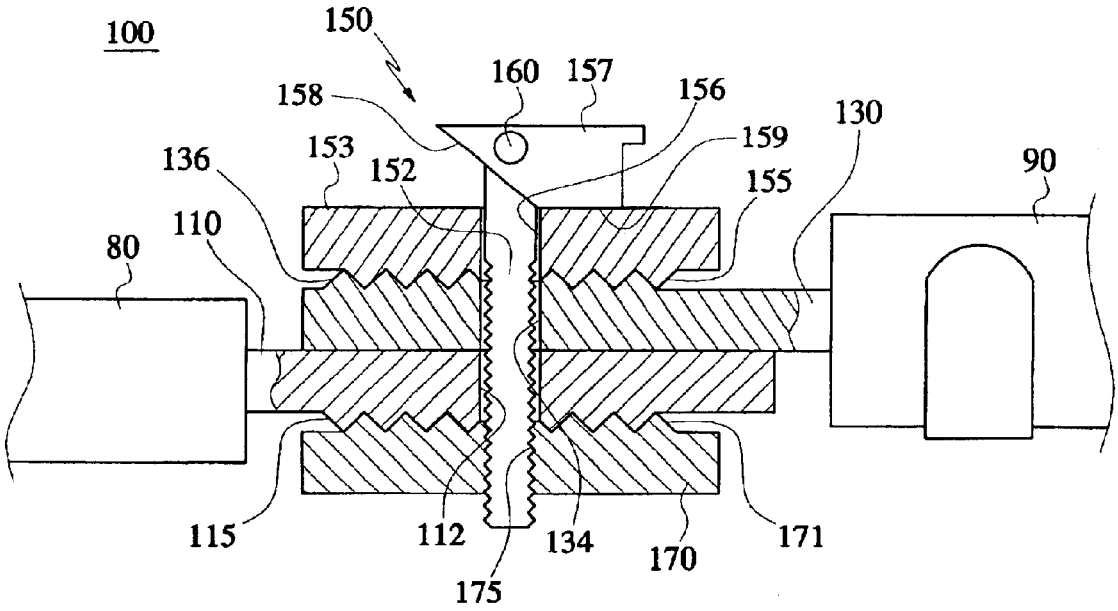
FIG. 5 is a cross sectional view of another embodiment of an electric terminal connection according to the present invention.

In the embodiment shown in FIG. 5, the surface of connection nut 170 contacting one of the terminals 110 and 130 can have serrations 171. When the connection nut 170 has serrations 171, the surface of the terminal in contact therewith preferably also includes serrations 115 corresponding to the serrations 171.

A method of setting up the high capacity electric terminal connection 100 of the present invention will now be described in more detail with respect to connecting a power supply unit 80 of semiconductor equipment to a high capacity power cable 90.

At first, a worker sets the first terminal 130, connected with the high capacity power cable 90, on the second terminal 110 connected with the power supply unit 80 of semiconductor device manufacturing equipment. The first terminal 130 includes a first connection through hole 134 in the middle thereof and a serrated surface 136 at the top thereof. The second terminal 110 includes a second connection through hole 112 in the middle thereof.

Figure 3:
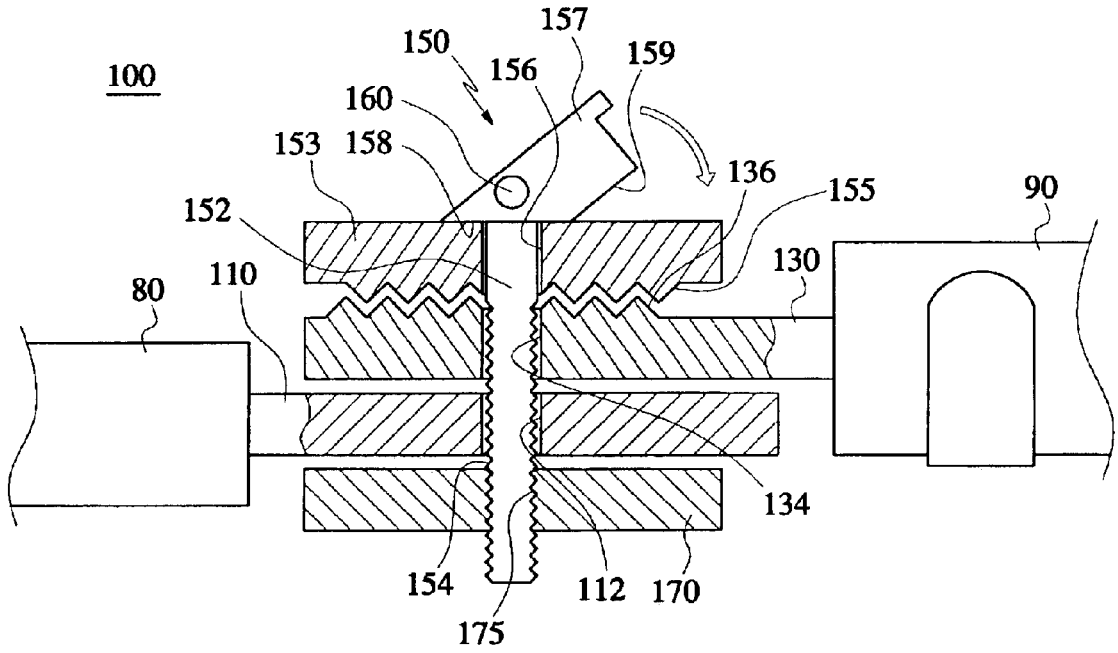
FIG. 3 is a cross-sectional view of the connection taken along line A—A of FIG. 2.

The worker inserts the bolt shaft 152 of the bolt unit 150 through the through hole 134 of the first terminal 130 and the through hole 112 of the second terminal 110. The threads 154 of the bolt shaft 152 are then engaged with the threads 175 of the connection nut 170 by rotating the nut 170 relative to the shaft 152. As a result, the first terminal 130 is connected with the second terminal 110. At this time, the worker does not exert a large amount of force to join the connection nut 170 to the bolt shaft 152. Accordingly, the screw threads 175 and 154 are not damaged. It is also preferable to leave the connection nut 170, the first and the second terminals 130 and 110, and the bolt head 153 spaced a predetermined distance apart from one another. Also, as shown in FIG. 3, at this time the sloped portion 158 of the bottom of the fixing bar 157 contacts the bolt head 153.

Figure 4:
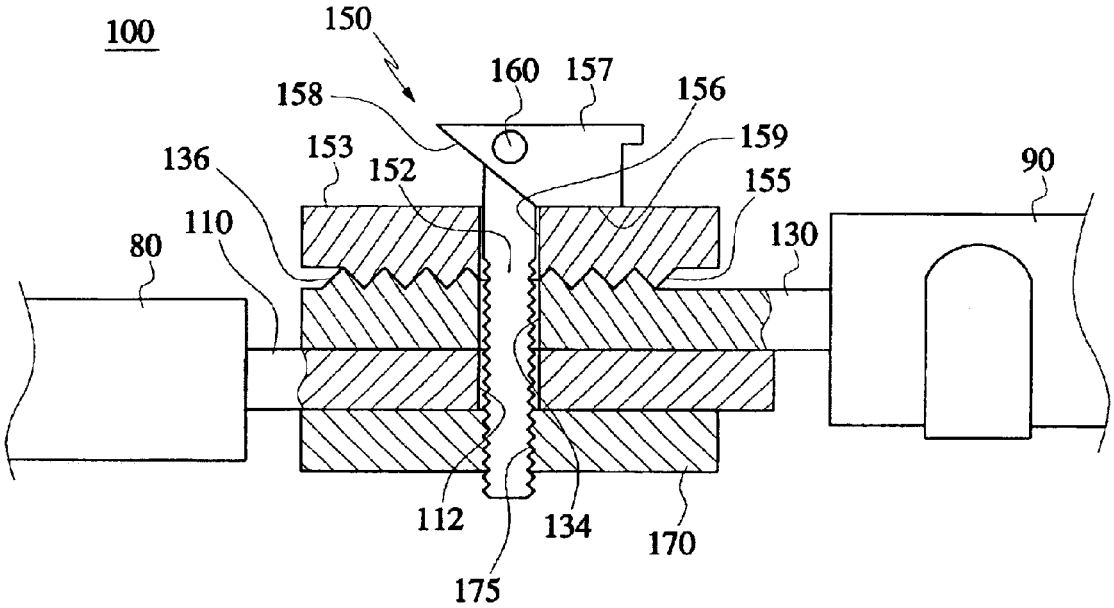
FIG. 4 is a similar cross-sectional view, but illustrating a state in which the high capacity electric terminals are securely fixed to one another.

The worker then pushes one end of the fixing bar 157 to rotate the bar 157 approximately 90° about the axis of pin 60 to a locking position wherein the first portion 159 of the fixing bar 157 is brought into contact with the bolt head 153. When the fixing bar 157 is rotated about 90° in this way, the bolt shaft 152 of the bolt unit 150, pinned to the fixing bar 157, moves upward a predetermined distance. The connection nut 170 joined with the bolt shaft 152 also is thus moved upward. As a result, as shown in FIG. 4, the bolt unit 150 serves as a toggle such that the first and the second terminal 130 and 110 are compressed between the fixing bar 157 and the connection nut 170.

The worker rotates the fixing bar 157 in the opposite direction to release the toggle and thereby separate the first terminal 130 and the second terminal 110. In this case, the inclined portion 158 of the bottom of the fixing bar 157 in brought into contact with the bolt head 153 again. The worker then unscrews the connection nut 170 from the bolt shaft 152 whereupon the first terminal 130 and the second terminal 110 are disconnected.

As described above, the high capacity electric terminal connection 100 of the present invention uses a pivotally supported fixing bar 157 to fix two terminals 130 and 110 compressively. Therefore, it is not necessary to exert a large amount of force on the nut and the bolt to secure the two terminals tightly together. Hence, it is unlikely that the nut and the bolt will be mistakenly damaged due to an excessive force. Accordingly, the nut and the bolt can be reused repeatedly.

Moreover, the friction force between the connection of two terminals 130 and 110 is relatively high because the high capacity electric terminal connection 100 of the present invention includes the serrated surfaces 155 and 171 engaged with one another at the area of contact between the two terminals 130 and 110. Therefore, the two terminals 130 and 110 directly can not be easily swung or slid relatively to each other by an external force. The friction force between the two terminals 130 and 110 is even greater when the two terminals 130 and 110 include respective series of concavities and convexities 136 and 115 engaged with corresponding series of concavities and convexities 155 and 171. In either case, the risk of fire is prevented.

In addition, the concavities and convexities 155, 171, 136, and 115 increase the area of contact between the two terminals 130 and 110 and the mechanism (nut 170 and bolt unit 150) connecting the two terminals 130 and 110. Therefore, the compressive stress is lower, whereby the less heat is generated in the contact area by the current passing therethrough. Accordingly, the risk of fire is eliminated.

Finally, although the present invention has been particularly shown and described with reference to the preferred embodiments thereof, it will be understood by those skilled in the art that the various changes in form and details may be made thereto without departing from the true spirit and scope of the invention as defined by the appended claims.

What is claimed is:

1. An electric terminal connection comprising:

first and second electric terminals each having a through hole, the terminals being juxtaposed with the through holes thereof aligned;

a bolt unit including a shaft having a threaded first end extending through the through holes of said first and second terminals, and a bolt head having a surface contacting one side of the first terminal; and a nut threaded to said shaft of the bolt unit and having a surface contacting a side of the second terminal remote from said first terminal, and wherein at least one of said surfaces has a first series of concavities and convexities, and said side of the terminal contacting said at least one of the surfaces has a second series of concavities and convexities engaged with said first series.

2. The electric terminal connection according to claim 1, wherein the head of the bolt unit has a central insertion hole therethrough, said shaft of the bolt unit has a second end extending through the insertion hole of the bolt head, and said bolt unit further includes a fixing bar disposed atop said head of the bolt unit and pivotally supported by said second end of the shaft of the bolt unit so as to be rotatable relative to said shaft about an axis extending perpendicular to the longitudinal axis of said shaft, said fixing bar having a bottom surface configured to exert a compressive force on said head of the bolt unit when said fixing bar is rotated about said axis from a first position to a second locking position.

3. The electric terminal connection according to claim 2, wherein the bottom surface of said fixing bar includes a first portion lying in a first plane parallel to the head of said bolt unit when said fixing bar is in said locking position thereof, and a second sloped portion extending contiguously from said first portion, said first and second portions of the bottom of said fixing bar subtending an obtuse angle.

4. The electric terminal connection according to claim 1, wherein said surface of the head of said bolt unit has the first of said series of concavities and convexities, and said one side of said first terminal has the second of said series of concavities and convexities engaged with said first series of concavities and convexities.

5. The electric terminal connection according to claim 4, wherein said surface of the nut has a third of said series of concavities and convexities, and said side of the second terminal has a fourth of said series of concavities and convexities engaged with said third series of concavities and convexities.

6. An electric terminal connection comprising:

first and second electric terminals each having a through hole, the terminals being juxtaposed with the through holes thereof aligned;

a bolt unit including a bolt head having a central insertion hole therethrough and a surface contacting one side of the first terminal, a shaft having a threaded first end extending through the through holes of said first and second terminals, and a second end extending through the insertion hole of said head, and a fixing bar disposed atop said head of the bolt unit and pivotally supported by said second end of the shaft of the bolt unit so as to be rotatable relative to said shaft about an axis extending perpendicular to the longitudinal axis of said shaft; and a nut threaded to said shaft of the bolt unit and having a surface contacting a side of the second terminal remote from said first terminal, and wherein said fixing bar has a bottom surface configured to exert a compressive force on said head of the bolt unit when said fixing bar is rotated about said axis from a first position to a second locking position.

7. The electric terminal connection according to claim 6, wherein the bottom surface of said fixing bar includes a first portion lying in a first plane parallel to the head of said bolt unit when said fixing bar is in said locking position thereof, and a second sloped portion extending contiguously from said first portion, said first and second portions of the bottom surface of said fixing bar subtending an obtuse angle.

* * * * *